US007915799B2

(12) United States Patent
Qian et al.

(10) Patent No.: US 7,915,799 B2
(45) **Date of Patent: *Mar. 29, 2011**

(54) FIELD EMISSION LAMP HAVING CARBON NANOTUBES

(75) Inventors: Li Qian, Beijing (CN); Liang Liu, Beijing (CN); Peng Liu, Beijing (CN); Jie Tang, Beijing (CN); Yang Wei, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 400 days.

This patent is subject to a terminal disclaimer.

(21) Appl. No.: 11/603,628

(22) Filed: Nov. 21, 2006

(65) Prior Publication Data

US 2007/0247071 A1 Oct. 25, 2007

(30) Foreign Application Priority Data

Mar. 22, 2006 (CN) ..... 2006 1 0060017

(51) Int. Cl.
*H01J 61/30* (2006.01)
*H01J 61/35* (2006.01)
*H01J 17/16* (2006.01)

(52) U.S. Cl. ..... 313/496; 313/634; 313/635; 313/311

(58) Field of Classification Search ..... 313/495–497, 313/306, 309–310, 346, 351, 355, 293–304, 313/623–625, 634–636, 493, 318.12, 570, 313/578; 118/50; 445/26, 27, 24
See application file for complete search history.

(56) References Cited

U.S. PATENT DOCUMENTS

| | | | | |
|---|---|---|---|---|
| 4,303,846 | A * | 12/1981 | Kimura et al. | 313/558 |
| 4,506,194 | A * | 3/1985 | Rigden et al. | 315/200 R |
| 4,806,826 | A * | 2/1989 | White et al. | 313/631 |
| 5,017,831 | A * | 5/1991 | Bouchard et al. | 313/558 |
| 6,239,547 | B1 * | 5/2001 | Uemura et al. | 313/495 |
| 6,455,021 | B1 * | 9/2002 | Saito | 423/447.3 |
| 7,332,856 | B2 * | 2/2008 | Kijima et al. | 313/495 |
| 7,365,482 | B2 | 4/2008 | Ryu et al. | |
| 2001/0015604 | A1 * | 8/2001 | Kerslick et al. | 313/310 |
| 2002/0021082 | A1 * | 2/2002 | Uemura et al. | 313/495 |
| 2002/0024290 | A1 * | 2/2002 | Uemura et al. | 313/477 R |
| 2002/0070648 | A1 * | 6/2002 | Forsberg | 313/309 |
| 2002/0074932 | A1 * | 6/2002 | Bouchard et al. | 313/495 |
| 2003/0013372 | A1 * | 1/2003 | Uemura et al. | 445/24 |
| 2003/0160561 | A1 * | 8/2003 | Park et al. | 313/495 |
| 2006/0071585 | A1 * | 4/2006 | Wang | 313/315 |

* cited by examiner

*Primary Examiner* — Bumsuk Won
*Assistant Examiner* — Elmito Breval
(74) *Attorney, Agent, or Firm* — Jeffrey T. Knapp

(57) ABSTRACT

A field emission lamp generally includes a bulb having an open end, a lamp head disposed at the open end of the bulb, an anode, and a cathode. The anode includes an anode conductive layer formed on an inner surface of the bulb, a fluorescent layer deposited on the anode conductive layer, and an anode electrode electrically connected with the anode conductive layer and the lamp head. The cathode includes an electron emission element and a cathode electrode electrically connected with the electron emission element and the lamp head. The electron emission element has an electron emission layer. The electron emission layer includes getter powders therein to exhaust unwanted gas in the field emission lamp, thereby ensuring the field emission lamp with a high degree of vacuum during operation thereof. A method for making such field emission lamp is also provided.

20 Claims, 4 Drawing Sheets

FIELD EMISSION LAMP HAVING CARBON NANOTUBES

RELATED APPLICATIONS

This application is related to commonly-assigned applications entitled, "FIELD EMISSION PLANE LIGHT SOURCE AND METHOD FOR MAKING THE SAME", application Ser. No. 11/603,639 and filed on Nov. 21, 2006, "FIELD EMISSION LAMP AND METHOD FOR MAKING THE SAME", application Ser. No. 11/603,640 and filed on Nov. 21, 2006, "FIELD EMISSION DOUBLE-PLANE LIGHT SOURCE AND METHOD FOR MAKING THE SAME", application Ser. No. 11/603,627 and filed on Nov. 21, 2006, and "FIELD EMISSION ELECTRON SOURCE AND METHOD FOR MAKING THE SAME", application Ser. No. 11/603,672 and filed on Nov. 21, 2006, the contents of each of which are hereby incorporated by reference thereto.

BACKGROUND

1. Technical Field

The invention relates generally to cold cathode luminescent field emission devices and, particularly, to a field emission lamp employing a getter to exhaust unwanted gas from therein, thereby ensuring a high degree of vacuum. The invention also relates to a method for making a field emission lamp.

2. Discussion of Related Art

Electrical lamps for daily living are usually incandescent lamps and/or fluorescent lamps. Ever since Thomas Edison invented the first viable incandescent lamps in 1879, the incandescent lamps have a long history for simple fabrication thereof. However, because an incandescent lamp emits light by incandescence of a tungsten filament, most of electric energy used therein is converted into heat and thereby is wasted. Therefore, a main drawback of the incandescent lamp is the low energy efficiency thereof.

A typical conventional fluorescent lamp generally includes a transparent glass bulb. The transparent glass bulb has a white or colored fluorescent material coated on an inner surface thereof and a certain amount of mercury vapor filled therein. In use, electrons are accelerated by an electric field, and the accelerated electrons collide with the mercury vapor. This collision causes excitation of the mercury vapor and causes radiation of ultraviolet rays. The ultraviolet rays irradiate the fluorescent material, whereby the ultraviolet rays are converted into visible light. Compared with the incandescent lamps, the fluorescent lamps have higher electrical energy utilization ratios. However, when the glass bulb is broken, the mercury vapor is prone to leak out and, thus, is poisonous and noxious to humans and is environmentally unsafe.

To settle the above problems, a kind of fluorescent lamps (i.e., field emission lamps) not adopting the mercury vapor has been developed. A conventional field emission lamp without the mercury vapor generally includes a cathode and an anode. The cathode has a number of nanotubes formed on a surface thereof, and the anode has a fluorescent layer facing the nanotube layer of the cathode. In use, a strong field is provided to excite the nanotubes. A certain amount of electrons is then accelerated and emitted from the nanotubes, and such electrodes collide with the fluorescent layer of the anode, thereby producing visible light.

For a field emission lamp, a high degree of vacuum in an inner portion (i.e., interior) thereof is a virtual necessity. In general, the better of the degree of vacuum of the field emission lamp is able to maintain during the sealing process and thereafter during use, the better of the field emission performance thereof is. To maintain the degree of vacuum of the field emission lamp within a desired range, a conventional way is to provide a getter in the inner portion thereof. Such a getter is able to exhaust a gas produced by the fluorescent layer and/or any other residual gas remaining within the field emission lamp upon sealing and evacuation thereof. The getter is generally selected from a group consisting of non-evaporable getters and evaporable getters.

For the evaporable getter, a high temperature evaporating process has to be provided during the fabrication of the field emission lamp, and a plane arranged in the inner portion of the field emission lamp has to be provided to receive the evaporated getter. Thus, the cost of the fabrication of the field emission lamp increases, and the cathode and anode are prone to shorting during the high temperature evaporating process, thereby causing the failure of the field emission lamp. For the non-evaporable getter, it is generally focused in a fixing head of the field emission lamp, which is typically located at a position away from the cathode, and, thus, the degree of vacuum of portions near to the cathode tends to be poorer, in the short-term, than that of portions near to the fixing head, at least until internal equilibrium can be reached, thereby decreasing the field emission performance of the cathode or at least potentially resulting in a fluctuating performance thereof.

What is needed, therefore, is a field emission lamp that overcomes the above-mentioned shortcomings to ensure a high degree of vacuum thereof, thus providing a better and more steady field emission performance during the use thereof.

What is also needed is a method for making such a field emission lamp.

SUMMARY

A field emission lamp includes a transparent bulb with an open end, a lamp head, an anode and a cathode. The lamp head is disposed on the open end of the bulb. An anode includes an anode conductive layer, a fluorescent layer, and an anode electrode. The anode conductive layer is formed on an inner surface of the bulb. The fluorescent layer is formed on a portion of a surface of the anode conductive layer, leaving an exposed portion on the anode conductive layer. The anode electrode is disposed on the open end of the bulb and electrically connecting the anode conductive layer with the lamp head. The cathode includes a cathode electrode and an electron emission element. An end of the cathode electrode is disposed on the open end of the bulb, insulated with the anode electrode, and electrically connected with the lamp head. The electron emission element is disposed on an opposite end of the cathode electrode and having an electron emission layer. The electron emission layer includes a glass matrix and a plurality of carbon nanotubes, getter powders, and metallic conductive particles dispersed therein.

A method for making a field emission lamp generally includes the steps of:

(a) providing a transparent glass bulb with an open end and a bulb interior; an anode electrode; a cathode electrode; a metallic base body; a lamp head; and a certain number of carbon nanotubes, metallic conductive particles, glass particles, and getter powders (i.e., in particulate or granular form), the bulb having an anode conductive layer on an inner surface thereof and a fluorescent layer on an inner surface of the anode conductive layer, the fluorescent layer facing the bulb interior;

(b) mixing the nanotubes, the metallic conductive particles, the glass particles, and the getter powders in an organic medium to form an admixture;

(c) forming a layer of the admixture on a surface of the base body;

(d) drying and baking the admixture at a temperature of about 300° C. to about 600° C. to form an electron emission layer on the base body, thereby obtaining an electron emission element; and (e) assembling the bulb, the anode electrode, the cathode electrode, and the electron emission element; and (f) sealing the open end of the bulb at a temperature of about 400° C. to about 500° C. in order to secure the anode electrode and the cathode electrode and evacuating the bulb interior, assembling the lamp head and electrically connecting the lamp head with the anode electrode and the cathode electrode, respectively, thereby yielding the field emission lamp.

Other advantages and novel features of the present field emission lamp and the relating method thereof will become more apparent from the following detailed description of preferred embodiments when taken in conjunction with the accompanying drawings.

BRIEF DESCRIPTION OF THE DRAWINGS

Many aspects of the present field emission lamp and the relating method thereof can be better understood with reference to the following drawings. The components in the drawings are not necessarily to scale, the emphasis instead being placed upon clearly illustrating the principles of the present field emission lamp and the relating method thereof. Moreover, in the drawings, like reference numerals designate corresponding parts throughout the several views.

The exemplifications set out herein illustrate at least one preferred embodiment of the present field emission lamp and the relating method thereof, in one form, and such exemplifications are not to be construed as limiting the scope of such a field emission lamp and a method for making such in any manner.

DETAILED DESCRIPTION

Reference will now be made to the drawings to describe, in detail, the field emission lamp and the method for making the same, according to the present embodiment.

Figure 1:
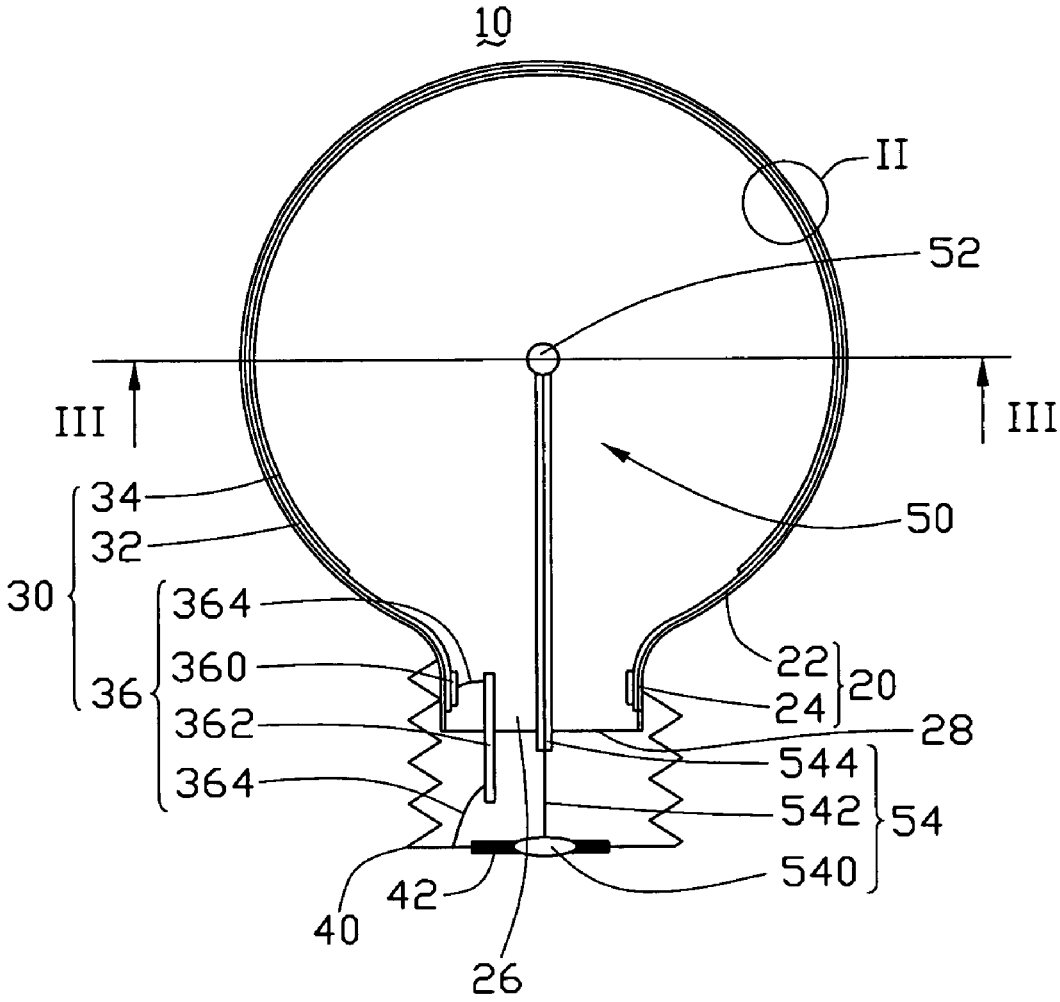
FIG. 1 is a cross-section view of a field emission lamp, in accordance with an exemplary embodiment of the present device.

Referring to FIG. 1, a field emission lamp 10, in accordance with an exemplary embodiment of the present device, is provided. The field emission lamp 10 includes a transparent glass bulb 20, an anode 30, a lamp head 40, and a cathode 50.

The glass bulb 20 includes a main portion 22 and a neck portion 24 extending from the main portion 22, the neck portion 24 having an open end 26. The main portion 22 is generally shaped as a ball/spherical shape, an ellipsoid shape, or another chosen shape that helps produce a desired distribution of light from the glass bulb 20. A ball shaped main portion 22 is shown in FIG. 1. The open end 26 of the neck portion 24 is sealed by an end piece 28, thereby forming a closed-off/sealed inner portion (i.e., interior) of the bulb 20. The sealed interior can be evacuated and such a vacuum maintained, facilitating the operation of the field emission lamp 10.

The lamp head 40 is secured on an outer portion of the neck portion 24 of the bulb 20. The lamp head 40 is advantageously made of a conductive and oxidation-resistant material (e.g., aluminum, copper, stainless steel, etc.). The lamp head 40 includes a securing portion (not labeled) and a bottom portion (not labeled). In order to fixing thereof with a predetermined device (not shown in the drawings), the securing portion is beneficially provided with a latch configuration, a screw-thread configuration, or another attachment means. A screw-thread securing portion is shown in FIG. 1. A thermally insulative medium 42 is formed on a middle portion of the bottom portion of the lamp head 40, thereby insulating the middle portion from other portions of the lamp head 40.

Figure 2:
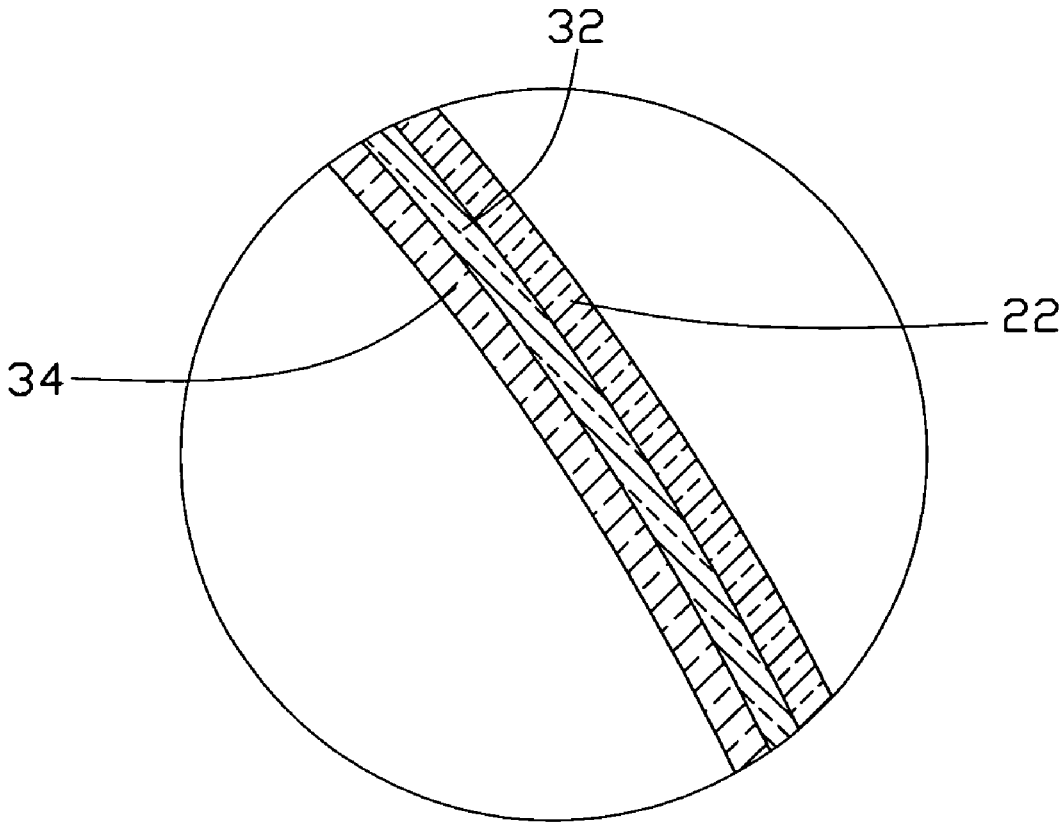
FIG. 2 is an enlarged view of a circled portion II of FIG. 1.

Referring to FIG. 2, the anode 20 includes an anode conductive layer 32 formed directly on the inner surface of the bulb 20, a fluorescent layer 34 deposited in contact with a surface of the anode conductive layer 32 facing the bulb interior, and an anode electrode 36 electrically connected with the anode conductive layer 32.

The anode conductive layer 32 entirely covers an inner surface of the main portion 22 of the bulb 20, extends towards the open end 26 of the neck portion 24, and covers an inner surface of the neck portion 24, partly or entirely. The anode conductive layer 32 is a transparent conductive film, such as an indium tin oxide (ITO) film. The fluorescent layer 34 partly covers the anode conductive layer 32 (e.g., advantageously the entirety thereof on the main portion 22), leaving the anode conductive layer 32 exposed at the neck portion 24 of the bulb 20. The fluorescent layer 34 is advantageously made of one of a white and color fluorescent material with such a fluorescent material usefully having many satisfactory characteristics (e.g., a high optical-electrical transferring efficiency, a low voltage, a long afterglow luminescence, etc.). Alternatively, an aluminum layer (not shown in the drawings) is formed on a surface of the fluorescent layer 34, in order to improve the brightness of the field emission lamp (due, e.g., to its high conductivity and its reflective nature) and to help prevent the fluorescent layer 34 from premature failure, reinforcing the layer and reducing the chances of spalling thereof.

The anode electrode 36 includes an anode down-lead ring 360, an anode down-lead pole 362, and a pair of anode down-lead wires 364. The anode down-lead ring 360 is disposed on an exposed portion of the anode conductive layer 32 and thus electrically connected therewith. The anode down-lead pole 362 is disposed and secured on the end piece 28 of the neck portion 22, with one end thereof in the inner portion of the bulb 20 and an opposite end thereof in the lamp head 40. One of the anode down-lead wires 364 electrically connects the end of the anode down-lead pole 362 with the anode down-lead ring 360, and the other anode down-lead wire 364 electrically connects the opposite end of the anode down-lead pole 362 with a portion of the lamp head 40 away from the thermally insulative medium 42. The anode down-lead ring 360, anode down-lead pole 362, and anode down-lead wires 364 are respectively made of a conductive material (e.g., copper, etc.), and the arrangements thereof are done in a manner so as to electrically connect the anode conductive layer 32 with the lamp head 40. Alternatively, the anode electrode 36 can have other configurations, such as a pole or a wire provided to electrically connect the anode conductive layer 32 with the lamp head 40 or such as a ring provided on a portion of the anode conductive layer 32 and a wire or a pole provided to electrically connect the ring with the lamp head 40.

The cathode 50 includes an electron emission element 52 and a cathode electrode 54. The electron emission element 52 is arranged in an inner portion of the main portion 22 of the bulb 20. The cathode electrode 54 includes a cathode electrode head 540, a cathode down-lead wire 542, and a hollow insulative glass column 544. The cathode electrode head 540 is disposed on a middle of the thermally insulative medium 42 of the lamp head 40 and is insulated from the lamp head 40. The cathode down-lead wire is received in the column 544 and electrically connects the electron emission element 52 with the cathode electrode head 540. An end of the column 544 directly, attachedly supports the electron emission element 52, and the other end of the column 544 is secured in place, via the end piece 28 of the neck portion 24 of the bulb 20.

In an alternative configuration, a metallic base column (not shown in the drawings) is provided to replace the glass column 544 and the cathode down-lead wire 542. One end of the metallic base column would support the electron emission element 52, a lower portion thereof would be secured via the end piece 28 of the bulb 20, and the other end (proximate the lower portion) thereof would electrically connect with the cathode electrode head 540.

Figure 3:
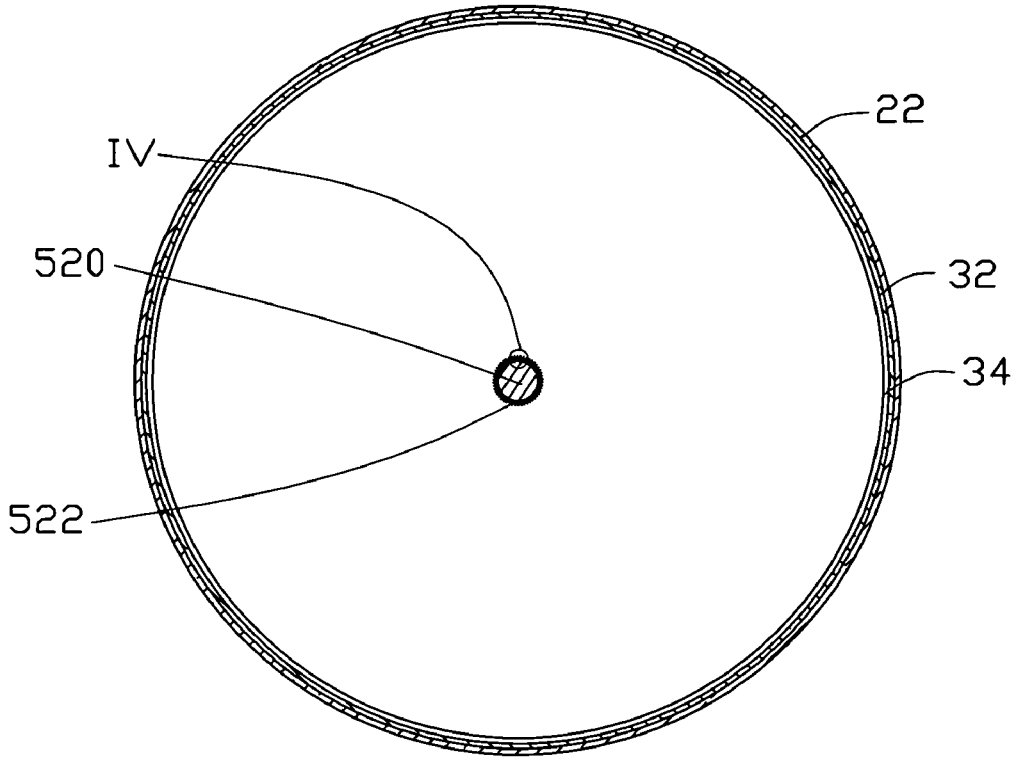
FIG. 3 is a cross-section view along a line III-III of FIG. 1.
Figure 4:
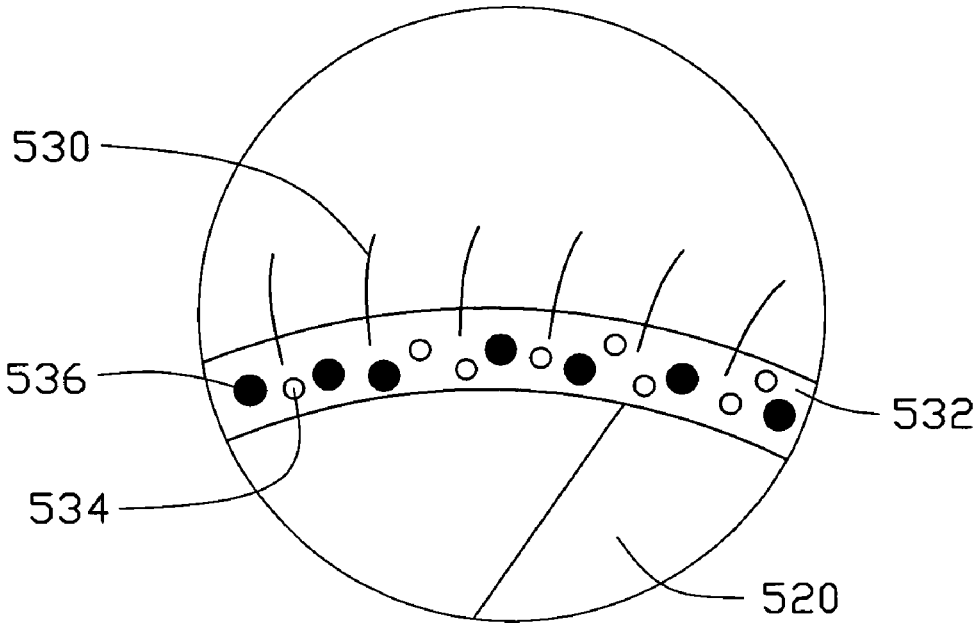
FIG. 4 is an enlarged view of a circled portion IV of FIG. 3.

Referring to FIGS. 3 and 4, the electron emission element 52 includes a metallic base body 520 and an electron emission layer 522 formed on a surface of the base body 520. The base body 520 is beneficially shaped corresponding to the shape of the main portion 22 of the bulb 20 (e.g., the base body 520 is preferably ball shaped if bulb 20 is ball shaped).

The electron emission layer 522 includes a plurality of carbon nanotubes 530, metallic conductive particles 534 and getter powders 536; and a glass matrix 532. Preferably, a length of each of the nanotubes 530 is in the approximate range from 5 micrometers to 15 micrometers, a diameter thereof is about in the range from 1 nanometer to 100 nanometers. An end of each nanotube 530 is advantageously exposed out from a top surface of the electron emission layer 522 and extends toward the bulb 20. Meanwhile, the remainder of each is anchored/embedded within the electron emission layer 522. The metallic conductive particles 534 are usefully made of a conductive material such as silver (Ag) or indium tin oxide (ITO) and are used to electrically connect the base body 520 with the nanotubes 530. The getter powders 536 are most suitably made of a non-evaporating getter material (e.g., a material selected from the group consisting of titanium (Ti), zirconium (Zr), hafnium (Hf), thorium (Th), aluminum (Al), thulium (Tm), and alloys substantially composed of at least two such metals.). The average diameter of the getter powders 536 is in the range from about 1 micrometer to about 10 micrometers.

In use, the lamp head 40 is grounded, and an appropriate negative voltage is applied to the cathode electrode head 540, resulting in a strong field between the anode conductive layer 32 of the anode 30 and the electron emission layer 522 of the cathode 50. The strong electrical field excites the carbon nanotubes 530 in the electron emission layer 522 to emit electrons. The electrons bombard the fluorescent layer 34, thereby producing visible light. Furthermore, the getter powders 536 exhaust gases produced by the fluorescent layer 34 and/or any residual gas in the field emission lamp 10 remaining upon evacuation, thus ensuring the field emission lamp 10 with a high degree of vacuum throughout its usage lifetime.

A method for making the above-mentioned field emission lamp 10 generally includes:

(a) providing a transparent glass bulb 20 with an open end 26; an anode electrode 36; a cathode electrode 54; a metallic base body 520; a lamp head 40; and a certain number of carbon nanotubes 530, metallic conductive particles 534, glass particles (later melted to form a glass matrix 532), and getter powders 536, the bulb 20 having an anode conductive layer 32 on an inner surface thereof and a fluorescent layer 34 on a surface of the anode conductive layer 32;

(b) mixing the nanotubes 530, the metallic conductive particles 534, the glass particles, and the getter powders 536 in organic medium to form an admixture;

(c) forming a layer of the admixture on a surface of the base body 520;

(d) drying and then baking the admixture at a temperature of about 300° C. to about 600° C. to soften and/or melt the glass particles to result in the glass matrix 532 with the nanotubes 530, the metallic conductive particles 534, and the getter powders 536 dispersed therein, in order to yield the electron emission layer 522 on the base body 520 thereby obtaining an electron emission element 52; and (e) assembling the bulb 20, the anode electrode 36, the cathode electrode 54 and the electron emission element 52; and (f) thereafter, sealing the open end 26 of the bulb 20 at a temperature of about 400° C. to about 500° C. in order to secure the anode electrode 36 and the cathode electrode 54 and evacuating the bulb 20 interior, assembling the lamp head 40 and electrically connecting the lamp head 40 with the anode electrode 36 and the cathode electrode 54, respectively, thereby yielding the field emission lamp 10.

In step (a), the carbon nanotubes 530 are formed by an appropriate technology (e.g., a chemical vapor deposition (CVD) method, an arc-discharge method, a laser ablation method, gas phase combustion synthesis method, etc.). Preferably, the average length of the nanotubes is in the range from about 5 micrometers to about 15 micrometers. The glass particles are selected from glass powders with a low melting temperature (e.g., glass powders with a low melting temperature in the range of about 350° C. to about 600° C., and preferably composed, in part, of silicon oxide ($SiO_2$), boric trioxide ($B_2O_3$), zinc oxide (ZnO), and vanadium pentoxide ($V_2O_5$)). The average diameter of the glass particles is preferably in the range of about 10 nanometers to about 100 nanometers. The metallic conductive particles 534 are ball-milled, yielding particle diameters in the range from about 0.1 micrometer to about 10 micrometers. The getter powders 536 are also ball-milled, forming powder diameters in the range from about 1 micrometer to about 10 micrometers. Preferably, the getter powders are made of a getter material with an activity temperature of about 300° C. to about 500° C. (e.g., an alloy containing Zr and Al).

The bulb 20 includes a main portion 22 and a neck portion 24 with an open end 26. The anode conductive layer 32 is formed directly on an inner surface of the bulb 20 (i.e., a surface facing the bulb interior and the cathode 50) by, e.g., a sputtering method or a thermal evaporating method. The fluorescent layer 34 is formed on and in contact with the anode conductive layer 32 by a depositing method.

In step (b), the organic medium is composed of a certain number of solvent (e.g., terpineol, etc.), and a smaller amount of a plasticizer (e.g., dimethyl phthalate, etc.) and stabilizer (e.g., ethyl cellulose, etc.). The percent by mass of the getter powders 536 is in the range of about 40% to about 80% of the admixture. The process of the mixing is preferably performed at a temperature of about 60° C. to about 80° C. for a sufficient period of time (e.g., about 3 hours to about 5 hours). Furthermore, low power ultrasound is preferably applied in step (b), to improve the dispersion of the carbon nanotubes 530, as well as the metallic conductive particles 534 and the getter powders 536.

Step (c) is performed in a condition of low dust content (e.g., being preferably lower than 1000 mg/m$^3$).

In step (d), the process of drying volatilizes the organic medium from the base body 520, and the process of baking is melts or at least softens the glass particles to permit the flow thereof in order to form the glass matrix 532 of the electron emission layer 522. The processes of drying and baking are performed in a vacuum condition and/or in a flow of a protective/inert gas (e.g., noble gas, nitrogen). An outer surface of the electron emission layer 522 is advantageously abraded and/or selectively etched, in order to expose ends of at least a portion of the nanotubes 530. The exposure of such ends increases the field emission performance of the electron emission layer 522.

In step (f), a sealing material (e.g., a glass with a melting temperature of about 350° C. to about 600° C.) is applied for the open end 26 of the bulb 20 and softened/formed at a temperature of about 400° C. to about 500° C. The sealing material forms the end piece 28 after cooling, to establish a chamber within the field emission lamp 10 that can then be evacuated.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope thereof.

What is claimed is:

1. A field emission lamp comprising:

a transparent bulb having an open end;

a lamp head located on the open end of the bulb;

an anode comprising an anode conductive layer, a fluorescent layer, and an anode electrode, the anode conductive layer being formed on an inner surface of the bulb, the fluorescent layer being created on a portion of a surface of the anode conductive layer to result in an exposed portion of the anode conductive layer, the anode electrode being located on the open end of the bulb, the anode electrode electrically connecting the anode conductive layer with the lamp head; and a cathode comprising a cathode electrode and an electron emission element, an end of the cathode electrode being located in the open end of the bulb and insulated from the anode electrode, the cathode electrode being electrically connected with the lamp head, the electron emission element being located on an opposite end of the cathode electrode and electrically connected therewith and away from the open end of the bulb, the electron emission element having an electron emission layer thereon, the electron emission layer emitting electrons to bombard the fluorescent layer and being comprised of a glass matrix and a plurality of carbon nanotubes, getter powders, and metallic conductive particles dispersed therein.

2. The field emission lamp as described in claim 1, wherein the getter powders are comprised of a non-evaporating getter material.

3. The field emission lamp as described in claim 1, wherein an average diameter of the getter powders is in the range from about 1 micrometer to about 10 micrometers.

4. The field emission lamp as described in claim 1, wherein getter powders are comprised of at least one material selected from the group consisting of titanium, zirconium, hafnium, thorium, aluminum, and thulium.

5. The field emission lamp as described in claim 1, wherein an average diameter of the nanotubes is in the range from about 1 nanometer to about 100 nanometers, and an average length thereof is in the range from about 5 micrometers to about 15 micrometers.

6. The field emission lamp as described in claim 1, wherein the metallic conductive particles are made of a material selected from indium tin oxide and silver, and an average diameter thereof is in the range from about 0.1 micrometer to about 10 micrometers.

7. The field emission lamp as described in claim 1, wherein the cathode electrode comprises an electrode head, a cathode down-lead wire, and a hollow glass column, the electrode head being located on a middle portion of the lamp head, the cathode down-lead wire electrically connecting the electrode head with the electron emission element, the hollow glass column receiving the cathode down-lead wire, an end of the column supporting the electron emission element and the other end thereof being secured in the open end of the bulb.

8. The field emission lamp as described in claim 7, wherein the electron emission element comprises a metallic base body and the electron emission layer is formed on a surface of the metallic base body, the plurality of carbon nanotubes is electrically connected to the cathode down-lead wire by the metallic conductive particles and the metallic base body.

9. The field emission lamp as described in claim 1, wherein the anode electrode comprises a pair of anode down-lead wires, an anode down-lead pole, and an anode down-lead ring, the ring is located on the exposed portion of the anode conductive layer, the anode down-lead pole is located on the open end of the bulb, one of the anode down-lead wires electrically connects an end of the anode down-lead pole with the ring, and the other anode down-lead wire electrically connects the other end of the anode down-lead pole with the lamp head.

10. The field emission lamp as described in claim 1, wherein the anode conductive layer is an indium tin oxide film.

11. The field emission lamp as described in claim 1, wherein an end of each nanotube is exposed out from a top surface of the electron emission layer and extends toward the bulb, and the remainder of each nanotube is anchored or embedded within the electron emission layer.

12. The field emission lamp as described in claim 1, wherein the electron emission element comprises a metallic base body and the electron emission layer formed on a surface of the metallic base body.

13. The field emission lamp as described in claim 1, wherein the bulb comprises a main portion and a neck portion extending from the main portion, and the neck portion having the open end.

14. The field emission lamp as described in claim 13, wherein the electron emission element is arranged inside the main portion of the bulb.

15. The field emission lamp as described in claim 14, wherein the main portion is spherical shape or ellipsoid shape.

16. The field emission lamp as described in claim 15, wherein the electron emission element is substantially located at a center of the main portion of the glass bulb.

17. The field emission lamp as described in claim 15, wherein the electron emission element comprises a metallic base body and the electron emission layer formed on a surface of the metallic base body, the base body is shaped corresponding to the shape of the main portion of the bulb.

18. The field emission lamp as described in claim 1, wherein some of the carbon nanotubes are dispersed among the metallic conductive particles and protrude out from the glass matrix.

19. A field emission lamp comprising:

a transparent bulb having an open end;

a lamp head located on the open end of the bulb;

an anode comprising an anode conductive layer, a fluorescent layer, and an anode electrode, the anode conductive layer being formed on an inner surface of the bulb, the fluorescent layer being created on a portion of a surface of the anode conductive layer to result in an exposed portion of the anode conductive layer, the anode electrode being located on the open end of the bulb, the anode electrode electrically connecting the anode conductive layer with the lamp head; and a cathode comprising a cathode electrode and an electron emission element, an end of the cathode electrode being located in the open end of the transparent bulb and insulated from the anode electrode, the cathode electrode being electrically connected with the lamp head, the electron emission element being located on an opposite end of the cathode electrode and electrically connected therewith and away from the open end of the bulb, the electron emission element having a metallic base body electrically connected to the cathode electrode and an electron emission layer located thereon, the electron emission layer emitting electrons to bombard the fluorescent layer and being comprised of a glass matrix and a plurality of carbon nanotubes, getter powders, and metallic conductive particles dispersed therein, wherein some of the carbon nanotubes are dispersed among the metallic conductive particles and protrude out from the glass matrix, and the carbon nanotubes are electrically connected to the metallic base body by the surrounding metallic conductive particles.

20. A field emission lamp comprising:

a transparent bulb having an open end;

a lamp head located on the open end of the bulb;

an anode comprising an anode conductive layer, a fluorescent layer, and an anode electrode, the anode conductive layer being formed on an inner surface of the bulb, the fluorescent layer being created on a portion of a surface of the anode conductive layer to result in an exposed portion of the anode conductive layer, the anode electrode being located on the open end of the bulb, the anode electrode electrically connecting the anode conductive layer with the lamp head; and a cathode comprising a cathode electrode and an electron emission element, an end of the cathode electrode being located in the open end of the transparent bulb and insulated from the anode electrode, the cathode electrode being electrically connected with the lamp head, the electron emission element being located on an opposite end of the cathode electrode and electrically connected therewith and away from the open end of the bulb, the electron emission element having a metallic base body electrically connected to the cathode electrode and an electron emission layer located thereon, the electron emission layer emitting electrons to bombard the fluorescent layer and being comprised of a glass matrix and a plurality of carbon nanotubes, getter powders, and metallic conductive particles dispersed therein, wherein the carbon nanotubes, getter powders, and metallic conductive particles are mixed with each other.

* * * * *